US008415548B2

(12) United States Patent
Johansen

(10) Patent No.: US 8,415,548 B2
(45) Date of Patent: Apr. 9, 2013

(54) DEVICE FOR DAMPING VIBRATIONS IN PERCUSSION SETS

(76) Inventor: Jarle Johansen, Frolandsverk (NO)

( * ) Notice: Subject to any disclaimer, the term of this patent is extended or adjusted under 35 U.S.C. 154(b) by 6 days.

(21) Appl. No.: 13/272,509

(22) Filed: Oct. 13, 2011

(65) Prior Publication Data

US 2012/0137854 A1 Jun. 7, 2012

(30) Foreign Application Priority Data

Oct. 13, 2010 (NO) ..... 20101418

(51) Int. Cl.
*G10D 13/02* (2006.01)

(52) U.S. Cl. ..... 84/421; 84/411 M

(58) Field of Classification Search ..... 84/411 M, 84/421

See application file for complete search history.

(56) References Cited

U.S. PATENT DOCUMENTS

| | | | | | |
|---|---|---|---|---|---|
| 2,163,949 | A * | 6/1939 | Kiemle | 84/402 |
| 3,335,870 | A * | 8/1967 | Hills | 211/85.6 |
| 4,216,695 | A * | 8/1980 | Hoshino | 84/421 |
| 4,319,514 | A * | 3/1982 | Donohoe | 84/421 |
| 4,430,017 | A * | 2/1984 | Stefancich | 403/104 |
| 4,526,083 | A * | 7/1985 | LeMert | 84/421 |
| 4,878,414 | A | 11/1989 | Yamashita | |
| 5,337,645 | A * | 8/1994 | Johnston | 84/421 |
| 5,454,288 | A | 10/1995 | Hoshino | |
| 5,934,629 | A * | 8/1999 | Peritz | 248/177.1 |
| 5,936,174 | A * | 8/1999 | Liao | 84/402 |
| 6,177,621 | B1 * | 1/2001 | Hoshino | 84/422.3 |
| 6,239,341 | B1 * | 5/2001 | Wang | 84/421 |
| 6,239,343 | B1 * | 5/2001 | Hoshino | 84/422.3 |
| 6,858,788 | B2 * | 2/2005 | Liao | 84/422.3 |
| 6,891,100 | B2 * | 5/2005 | Crouch | 84/421 |
| 7,394,009 | B2 * | 7/2008 | Judd | 84/421 |
| 7,915,507 | B2 * | 3/2011 | Onheiser | 84/421 |
| 8,334,448 | B2 * | 12/2012 | Onheiser | 84/421 |
| 2007/0120301 | A1 * | 5/2007 | Domen et al. | 267/152 |
| 2010/0294111 | A1 * | 11/2010 | Carraro | 84/421 |
| 2012/0137854 | A1 * | 6/2012 | Johansen | 84/411 M |

OTHER PUBLICATIONS

Search Report dated May 13, 2011, for Norwegian Application No. 20101418.

* cited by examiner

*Primary Examiner* — David Warren
*Assistant Examiner* — Robert W Horn
(74) *Attorney, Agent, or Firm* — Locke Lord LLC

(57) ABSTRACT

It is disclosed a device for dampening vibrations that ma propagate from a percussion instrument to percussion instrument stands comprising a mounting holder (3) for the percussion instrument, sad mounting holder (3) being anchored in an elastic/resilient and vibration-dampening material (2), said elastic/resilient and vibration-dampening material (2) being carried by a casing/sheath (4), said casing/sheath (4) being connected to or being attachable to a stand.

13 Claims, 4 Drawing Sheets

DEVICE FOR DAMPING VIBRATIONS IN PERCUSSION SETS

The present application claims priority to Norwegian Patent Application No. 20101418, filed Oct. 13, 2010.

FIELD OF THE INVENTION

The disclosed device generally relates to dampening vibrations in percussion sets.

BACKGROUND OF THE INVENTION

Musical instruments function in a variety of ways to produce sound vibrations that are then carried in the air, received by the ear, and interpreted in the brain in order to provide a sensory experience. The composer of a piece of music creates the piece with the intention that it be conveyed by the intended instruments in the form of a pure tone produced by the actual instrument used. Any extraneous sounds are unwelcome and detrimental both for the composer and for the audience.

In order to play a musical piece, it is usually necessary to keep the beat intact and, preferably, to employ instruments that give a tonal picture to the beat and/or to the underlying tonal elements in a musical piece. For example, in many musical pieces, it is necessary to use percussion in the form of drums (with or without drumsticks), cymbals (used with various types of striking devices such as drumsticks, whisks, rubber-tipped sticks, metallic striking devices, etc.) and so on. Many of these musical instruments, however, demand too much space and/or are heavy to handle and use without being attached to some type of stand or mounting arrangement. In so doing, it is possible that a tone problem can occur the stand/mounting device itself ending up "stealing" vibrations from the percussion instrument either by exerting a damping effect on the instrument itself, by producing sounds that are undesirable within the tonal picture of the music piece, or by transmitting vibrations to the mounting surfaces of the stand, i.e. the walls or the floor, or all or some of the above concurrently.

As a result, there is a need for an arrangement which would dampen/remove such undesired vibration transmission to the stands/percussion unit brackets and holders. This is especially true for cymbal holders, brackets and stands.

When a cymbal is struck, energy is transmitted, which causes the cymbals to reverberate and to produce sound. With a conventional stand, much of the cymbal's energy is dissipated away in the stand. This can be experienced, for example, by placing one's hand on the stand after having struck the cymbal, and is especially the case for large cymbals. This means that the cymbal uses much of its energy in "moving/vibrating" the stand instead of all the energy producing sound. As a result of this, a tone of shorter resonance will be achieved, and the cymbal sound will be somewhat muffled.

A one-piece, reversible attachment device for cymbals was previously disclosed in U.S. Pat. No. 4,216,695 which allowed the choice of attachment type between a "loose" and a "firm" mounting. However, in that case, the problem of "vibration stealing" by the stand was not mentioned, and only felt plates/felt pads were shown connecting the cymbal to the stand.

In conventional arrangements, felt is employed between the stand and the cymbal, and this is meant to absorb vibrations and prevent their transmission. This is, however, not a complete solution, but the felt, in itself, can act as an inefficient vibration-damping medium. In addition, the central upright bolt on which the cymbal rests is directly attached to the stand, and this bolt will thus transmit much vibration from the cymbal to the stand. This effect is also reinforced by the fact that the cymbal often hangs at a tilt (with respect to the vertical), and thus, rests directly on the bolt. In such a mounting arrangement, the same problem of transmission of vibrations arises when the cymbals reverberate and make contact with the bolt.

SUMMARY OF THE INVENTION

The present invention concerns a device being suitable for dampening vibrations that may be transmitted from percussion sets to percussion holders and stands. The device comprises a mounting holder for percussion instruments, said mounting holder being anchored to an elastic/resilient and vibration-dampening material, said elastic/resilient and vibration-damping material being carried by a casing, said casing being connected to or being connectable to a stand, the mounting holder being equipped with or may be associated with/secured to a device preventing the percussion instrument from coming into direct contact with the casing.

A device for dampening vibrations that may propagate from a percussion instrument to a percussion instrument holder is disclosed comprising a mounting holder for the percussion instrument. The mounting holder being anchored in an elastic or resilient and vibration-dampening material. The elastic or resilient and vibration-dampening material being carried by a casing or sheath. The casing or sheath being connected to or being attachable to a stand.

Further disclosed embodiments involve a device wherein the mounting holder is equipped or may be associated or secured to a device preventing the percussion instrument from coming into direct contact with the casing or sheath. Further disclosed embodiments involve a device in which the vibration-dampening material does not abut against the casing or sheath over parts of the walls of the casing or sheath. Further disclosed embodiments involve a device in which the vibration-dampening material is held in place in the casing or sheath by the aid of an edge or flange. Further disclosed embodiments involve a device in which the flange is detachable. Further disclosed embodiments involve a device in which the vibration-dampening material may be removed from the casing or sheath. Further disclosed embodiments involve a device in which the vibration-dampening material is made of a polymer material such as rubber and/or plastic, or crude rubber. Further disclosed embodiments involve a device in which the vibration-dampening material comprises a number of discs placed on the mounting holder. Further disclosed embodiments involve a device in which the vibration-dampening material comprises a mixture of different elastic or resilient materials either as a mixture of discrete material sections or as a mechanical mixture of different elastic or resilient materials. Further disclosed embodiments involve a device further comprising additional bracing devices in the vibration-dampening material for bracing the movements of the mounting holder. Further disclosed embodiments involve a device in which the bracing device is a spring.

GENERAL DISCLOSURE OF THE INVENTION

The present invention concerns a device in the form of an intermediate adapter that can be installed between a percussion instrument and a percussion instrument stand in order to inhibit/prevent the transmission of vibrations from the percussion instrument to the percussion instrument stand (and optionally further to the floor or to other surfaces onto which the stand is mounted).

In this context, a stand is meant to be a device that connects the percussion instrument to a horizontal or vertical surface. Under normal circumstances, a stand will consist of a vertical rod equipped with legs (collapsible or fixed), and the percussion instrument is attached to the top of this vertical rod. However in the present context, a stand can also be a wall-mounted bracket or another device used for mounting the percussion instrument to a vertical surface. A stand can also include branches, such as a stand shared by several percussion instruments or a shared stand for drums or cymbals.

The device according to the invention comprises a mounting holder for a percussion set, said mounting holder being embedded in an elastic/resilient and vibration-damping material. The elastic/resilient and vibration-damping material is carried in a casing which is attached, or can be attached, to a percussion instrument stand. The mounting holder is equipped with, or can be connected/attached to, a device for preventing the percussion unit from coming into direct contact with the casing.

The invention will be described in more detail below with reference to the accompanying figures.

Figure 7A:
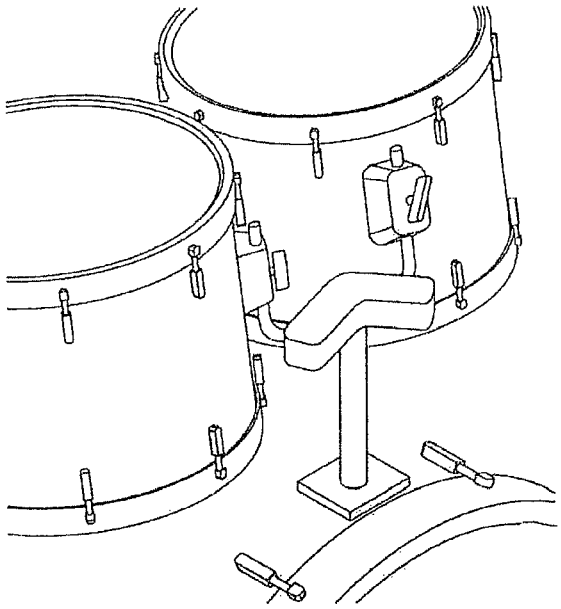
Figure 7B:
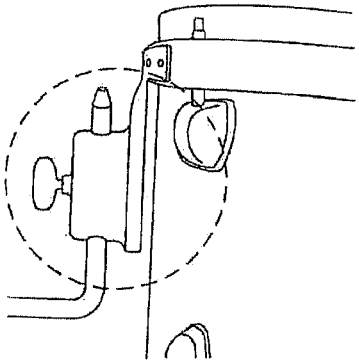
Figure 7C:
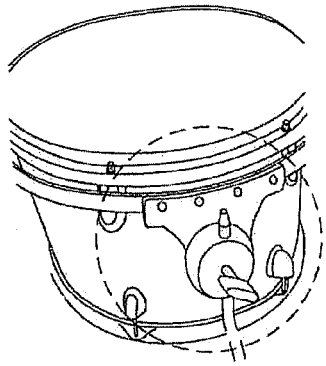

FIG. 7*a*-7*c* show the placement of a vibration-damper on a drum set.

DETAILED DISCLOSURE OF THE INVENTION

With reference to the figures, the function and construction of the device according to the invention will be disclosed below. Unless otherwise stated, the same reference number refers to the same components in the various figures.

Figure 1:
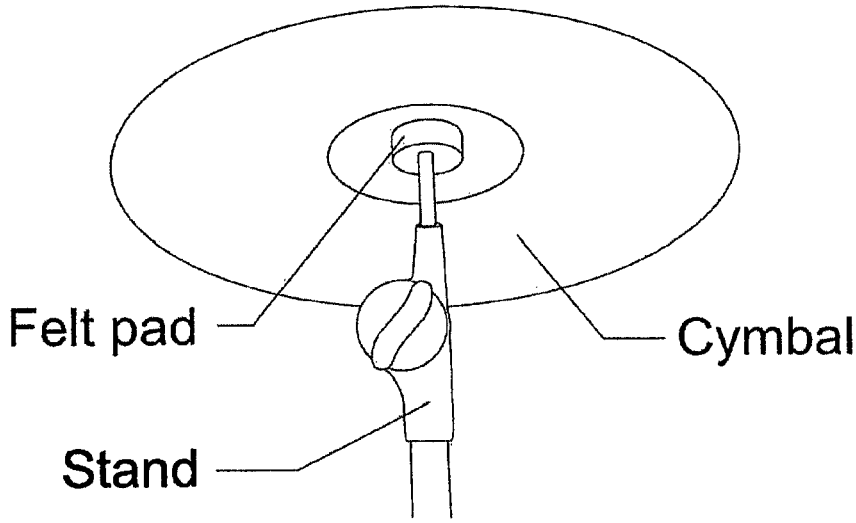
FIG. 1 shows a conventional setup for a cymbal on a cymbal stand.
Figure 2:
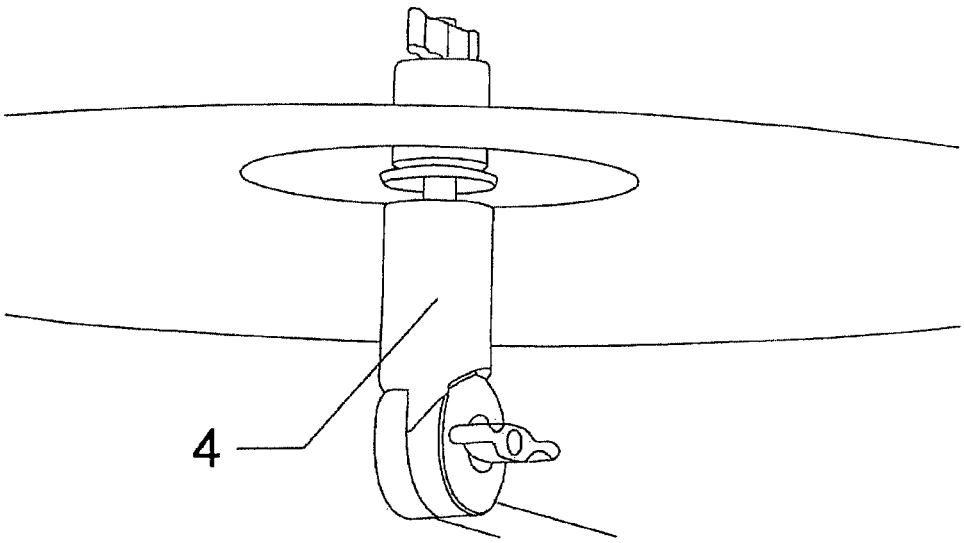
FIG. 2 shows a connection between a cymbal and a stand with an intermediate device constructed for blocking the transmission of vibrations according to the invention.
Figure 3:
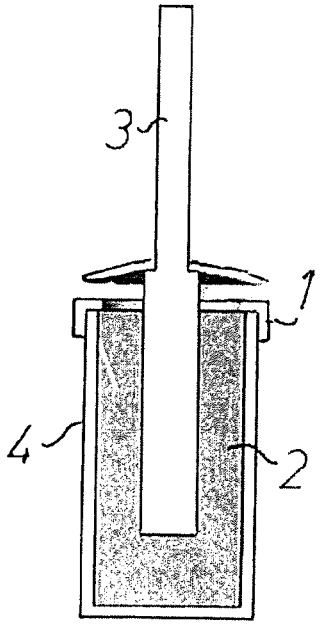
FIG. 3 shows a cross-section of a device construction according to the invention.

A simplified embodiment of the device according to the invention, is shown in FIG. 3 and is also referred to in Example 1 below. According to the invention, the device comprises a mounting rod/mounting holder 3 for a percussion instrument (such as a cymbal, as shown in FIG. 1). The depicted mounting rod 3 is secured to (for example, embedded permanently into, or cemented to) a vibration-damping material 2 such as plastic, rubber, a polymer material, etc. The vibration-blocking material 2 is enclosed in and carried by a sheath/container 4 (with closed or open walls). In this context, the actual "container" can have any kind of external shape. In the figures, it has an overall cylindrical shape, but other forms are also possible such as a container with an oval, or a polygonal (for example, hexagonal), cross-section, etc. It is important that no other connection exists between the mounting rod 3 and the container 4 than that provided by the vibration-damping material 2, so that any vibration transmitted by the mounting rod 3 does not propagate to the container 4.

In one version of the device according to the invention, a spacer/barrier is installed in the gap above the top edge of the container 4 and on the mounting rod 3 for the percussion instrument, and this spacer/barrier acts to prevent any percussion instrument mounted onto the mounting rod from coming into direct contact with the container 4. The spacer can also be, for example, the length of the mounting rod 3 that can abut against the bottom of the mounting socket in, for example, a percussion unit. Other devices which prevent the percussion instrument from coming into contact with the container 4 fall within the scope of the present invention as well. The spacer can be made as an integrated part of the mounting rod 3 or it can be attached as a separate component onto the mounting rod 3, for example, with the help of a threaded connection.

In one embodiment of the device according to the invention, the vibration-damping material 2 may be mounted in such a way that it can be detached from the container 4. In such a construction, container 4 may be equipped with a flange or rim 1 that, when installed, will hold the vibration-damping material in place within the container 4. The flange or rim 1 can also be made in the form of a detachable ring in order to allow the removal of the vibration-blocking material 2. This might be advantageous, for example, when replacing the vibration-damping material 2 if it becomes ineffective due to age or if, in some other way, it becomes damaged or destroyed, or if it is desirable to replace the mounting rod 3 (in cases where the mounting rod 3 and the vibration-dampening material 2 are fabricated as one integrated component, for instance, where the mounting rod 3 is pre-cast into the vibration-damping material).

Figure 4:
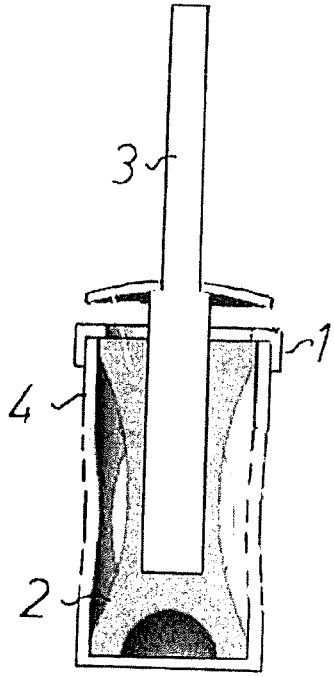
FIG. 4 shows a cross-section of an alternative device construction according to the invention.
Figure 5:
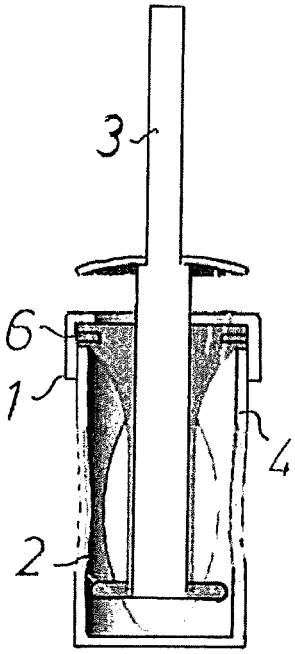
FIG. 5 shows a cross-section of yet another alternative device construction according to the invention.
Figure 6:
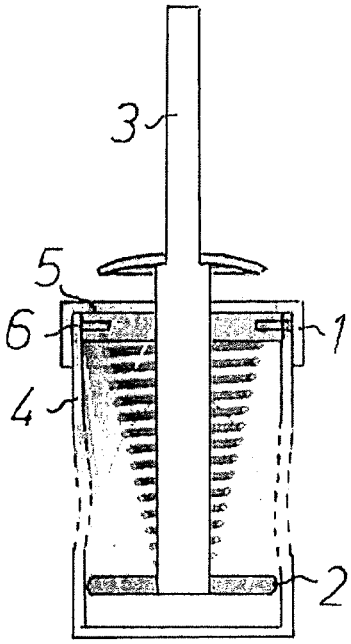
FIG. 6 shows a cross-section of yet another alternative device construction according to the invention.

It is not necessary that the vibration-damping material 2 touch the walls of the container 4 over its entire length, and neither is it necessary that the walls inside the container 4 be solid/"filled". It can actually be beneficial if the vibration-damping material 2 does not touch the walls of the container 4 in any place other than at its top and bottom. Such embodiments are shown in FIG. 4, FIG. 5, and FIG. 6. To the extent that the vibration-damping material, for example, cannot completely prevent vibration transmission to the walls of the container 4, a gap between the walls of the container and the vibration-damping material might be beneficial. This feature of the arrangement according to the invention will also make it possible to fabricate the device in various designs. It can also be possible to have vibration-damping material 2 only in the top and bottom of the container 4. Such a design is shown in FIG. 6. It can also be possible to fabricate the vibration-damping material 2 from a number of discs which are set at a particular spacing from each other in the container 4 (not shown). The vibration-damping material may also be made of any number of combinations of elastic/resilient materials, either as a number of separate units e.g. stacked on top of each other or as cast or mixed separate units making up the vibration-damping material or as a mechanical or chemical mixture or composition of different polymers/copolymers.

The container 4 is preferably equipped with devices (not shown) for attaching it to a support stand or it can itself form an integrated part of such a stand. The attachment devices connected to the container 4 may be of various types, and they can exist as snap-on fasteners, wing-nut fasteners, bayonet-type fasteners, etc. Here, the musician has the option of choosing the type of attachment device based on his own professional experience.

The vibration-damping material 2 (for example, a rubber material, or discs made up of rubber or some other compressible material) and the rod 3, as well as any other components contained in the container 4, may be produced as one or several separate internal components in the container 4, and such an internal component can possibly be produced in various levels of hardness (for example, three different hardness levels) in order to give the performer the option of choosing the level of vibration-damping best suited to the actual percussion unit involved.

EXAMPLES

Example 1

An example of a vibration-damping device according to the invention is the case where the outer container 4 is a cylinder with dimensions of 50 mm in height and 30 mm in diameter. The walls of this container have a thickness of 2 mm and are solid/without gaps/holes. The container 4 is filled with a filler 2 of crude rubber and in this crude rubber is placed a central rod 3 made of steel and with a length of 110 mm. The rod 3 is cast into the crude rubber material 2 over a length of 43 mm and the axis of the rod 3 is aligned parallel with the walls of the container 4. On the rod 3, and at a distance of 6 mm from the top of the container 4, a convex circular steel plate is mounted, having a diameter of 40 mm and a thickness of 2 mm, in order to prevent vibrations reaching the walls of the container 4. In order to hold the rubber material 2 in place within the container 4, an attachment ring 1 is mounted on the top of the container 4 using threaded connectors which work in concert between the attachment ring 1 and the top of the container 4.

Example 2

This example is related to the embodiment of the device according to the invention shown in FIG. 4. This example shows a vibration-damping device according to the invention in which the container 4 is a cylinder with dimensions of 50 mm in height and 30 mm in diameter. The walls in this container 4 have a thickness of 2 mm and three openings have been made in the container wall in order to allow the release of air when the vibration-damping material 2 (the rubber) moves. The container 4 encloses a vibration-damping material 2 composed of crude rubber, and this material 2 is designed with concave walls and with a concave bottom in order to provide contact surfaces with the container 4 only in its annular bottom and top areas, and the vibration-damping material 2 can be held firmly within the container 4 by an attachment ring 1 mounted at the top of the container 4. The diameter in the middle area of the vibration-damping material 2 in this example is 20 mm, while the top and bottom areas have an inner diameter corresponding to that of the container 4. A steel rod 3 of length 110 mm is placed centrally in this vibration-damping material 2 composed of crude rubber. The rod 3 is pre-cast into the crude rubber material 2 over a length of 43 mm and the axis of the rod 3 is aligned parallel with the walls of the container 4. The rubber 2 is replaceable and is held in place by a nut 1 at the top of the container 4. On the rod 3, and at a distance of 6 mm from the top of the container 4, a convex circular steel plate is mounted, having a diameter of 40 mm and a thickness of 2 mm, in order to prevent vibrations reaching the walls of the container 4.

Example 3

This example relates to the construction of the arrangement according to the invention shown in FIG. 5. The vibration-damping device according to the invention is, in this embodiment, fabricated in such a way that the outer container 4 is a cylinder and has dimensions of 50 mm in height and 30 mm in diameter. In the container is placed a vibration-damping material 2 made of crude rubber. The walls of this container 4 have a thickness of 2 mm, and three openings have been cut in the wall of the cylinder 4 in order to release air when the rubber 2 moves. The rubber material 2 is constructed with concave walls and a convex bottom in order to provide contact surfaces with the container 4 only at its annular bottom and top areas. The vibration-damping material 2 is held firmly within the container 4 by an attachment ring 1 mounted at the top of the container 4. In order to provide an additional means of holding the rubber 2 firmly inside the container 4 in this design, a disc 6 is pre-cast into the rubber 2 in order to stabilize the connection between the rubber and the attachment ring 1. The base of the rubber 2 is shaped like a disc, and this disc is 4 mm thick, with a diameter that is 3 mm smaller then the inner diameter of the casing 4. In this rubber damper, a steel rod 3 with a length of 110 mm is centrally placed. The rod 3 is pre-cast into the crude rubber material 2 over a length of 43 mm and the axis of the rod 3 is aligned parallel to the walls of the container 4. The rubber material 2 is replaceable, and is held in place by a nut 1 at the top of the container 4. On the rod 3, and at a distance of 6 mm from the top of the container 4, a convex circular steel plate is mounted, having a diameter of 40 mm and a thickness of 2 mm, in order to prevent vibrations from reaching the walls of the container 4.

Example 4

This example relates to the construction of the device according to the invention shown in FIG. 6. Example 4 of a vibration-damping device according to the invention consists of an outer container 4 in the shape of a cylinder with dimensions of 50 mm in height and 30 mm in diameter. The walls of this container 4 have a thickness of 2 mm, and three openings have been made in the wall of the cylinder 4. Mounted onto the container 4 is a purpose-made damper which consists of a combination of a spring 7 and a vibration-damping material 2. The vibration-damping material in this construction is composed of a rubber disc 5 placed at the top of the container 4 and an additional rubber disc 2 placed on the bottom of the container 4. In the damper arrangement according to this embodiment, a central rod 3 passes through the container 4. The rubber disc 2 is attached to the lower part of the rod 3. The lower part of the rod 3 is not in contact with the bottom of the container 4, and the rubber disc 2 is smaller (in this example, 2 mm smaller) than the inner diameter of the container 4. In this way, the rod 3 on which the percussion instrument (cymbal) rests, is able to move relatively freely, but will still be stable. The rubber disc 5 is attached to the rod 3 and, in addition, is also attached to the container 4 by a nut 1 at the top of the cylinder 4. The spring 7 is attached at the top to the rubber disc 5 without any vibration-related connection (i.e. with a vibration-damping connection) with components that are in contact with, or which constitute the outer container 4. The rubber disc 5 is attached to the container 4 via an internal steel plate 6 that serves to stabilize the rubber disc 5. The rubber disc 5, in this example, is 4 mm thick and helps in stabilizing the rod 3. The spring 7 also has the function of providing additional stabilization of the movements of the rod, as the lower rubber disc 2 can move around to a certain degree in the bottom section of the container 4. The rubber discs 5 and 2 will serve to prevent vibrations from propagating from the rod 3 to the container 4.

The rubber disc 5, the rubber disc 2, the spring 7, and the rod 3 can be produced as a separate internal component in the container 4, and such a component may possibly be produced in various hardness grades (for example three different hardness grades) in order to give the performer the option of choosing the level of vibration-damping best suited to the actual percussion instrument involved. Such internal components may be exchanged with each other or replaced by releasing the nut 1 at the top of the container 4, removing the existing internal component from the container 4, and replacing it with a new one.

The central rod 3 in this example is made of steel and has a length of 110 mm. With vertical placement of the container 4, the axis of the rod is aligned parallel to the walls of the container 4. On the rod 3, and at a distance of 6 mm from the top of the container 4, a convex circular steel plate is mounted, with a diameter of 40 mm and a thickness of 2 mm, whose purpose is to prevent vibrations from reaching the walls of the container 4.

What is claimed is:

1. A device for dampening vibrations that may propagate from a percussion instrument to a percussion instrument holder, comprising a mounting holder for the percussion instrument, said mounting holder being anchored in an elastic or resilient and vibration-dampening material, said elastic or resilient and vibration-dampening material being carried by a casing or sheath, said casing or sheath being connected to or being attachable to a stand.

2. A device according to claim 1, wherein the mounting holder is equipped or may be associated or secured to a device preventing the percussion instrument from coming into direct contact with the casing or sheath.

3. A device according to claim 1, wherein the vibration-dampening material does not abut against the casing or sheath over parts of the walls of the casing or sheath.

4. A device according to the claim 1, wherein the vibration-dampening material is held in place in the casing or sheath by the aid of an edge or flange.

5. A device according to claim 4, wherein the flange is detachable.

6. A device according to any of the claim 1, wherein the vibration-dampening material may be removed from the casing or sheath.

7. A device according to claim 1, wherein the vibration-dampening material is made of a polymer material such as rubber and/or plastic, or crude rubber.

8. A device according to claim 1, wherein the vibration-dampening material comprises a number of discs placed on the mounting holder.

9. A device according to claim 1, wherein the vibration-dampening material comprises a mixture of different elastic or resilient materials either as a mixture of discrete material sections or as a mechanical mixture of different elastic or resilient materials.

10. A device according to claim 1, further comprising additional bracing devices in the vibration-dampening material for bracing the movements of the mounting holder.

11. A device according to claim 10, wherein the bracing device is a spring.

12. A method for dampening vibrations between a stand and a cymbal, comprising:

positioning the device according to claim 1 between the stand and the cymbal;

playing the stand and the cymbal.

13. A method for dampening vibrations between a stand and a drum or set of drums, comprising:

positioning the device according to claim 1 between the stand and the drum or set of drums;

playing the stand and the drum or set of drums.

* * * * *